US007162845B2

(12) United States Patent
Messiqua

(10) Patent No.: US 7,162,845 B2
(45) Date of Patent: Jan. 16, 2007

(54) CONCRETE FORMWORK WALL SERVING ALSO AS REINFORCEMENT

(75) Inventor: Pierre Messiqua, Mies (CH)

(73) Assignee: Coffor Internacional-Exploracao de Patentes LDA, Madeira (PT)

( * ) Notice: Subject to any disclaimer, the term of this patent is extended or adjusted under 35 U.S.C. 154(b) by 241 days.

(21) Appl. No.: 10/416,571

(22) PCT Filed: Jan. 10, 2001

(86) PCT No.: PCT/IB01/00017

§ 371 (c)(1),
(2), (4) Date: May 13, 2003

(87) PCT Pub. No.: WO02/38878

PCT Pub. Date: May 16, 2002

(65) Prior Publication Data

US 2004/0020149 A1 Feb. 5, 2004

(30) Foreign Application Priority Data

Nov. 13, 2000 (EP) ..... 00124716

(51) Int. Cl.
*E04B 1/00* (2006.01)
*E04B 1/74* (2006.01)

(52) U.S. Cl. ..... 52/404.1; 52/405.2; 52/405.3; 52/407.3; 52/419; 52/425; 52/426; 52/432; 52/424; 52/745.05; 52/745.08; 52/745.09; 52/745.15; 52/745.19; 52/742.14

(58) Field of Classification Search ..... 52/405.2, 52/405.3, 407.3, 432, 479, 419, 424–426, 52/741.1, 742.1, 742.12, 742.13, 742.14, 52/745.05, 745.06, 745.09, 745.1, 745.13, 52/745.15, 745.16, 745.17, 745.18, 745.19, 52/746.1, 746.11, 747.1; 249/83–97
See application file for complete search history.

(56) References Cited

U.S. PATENT DOCUMENTS 2,337,743 A * 12/1943 Deuel ..... 52/94
3,750,355 A * 8/1973 Blum ..... 52/309.12
3,982,368 A * 9/1976 Perrin ..... 52/381
4,133,156 A * 1/1979 Unger ..... 52/383

(Continued)

FOREIGN PATENT DOCUMENTS

EP 0 055 504 7/1982

(Continued)

*Primary Examiner*—Jeanette E. Chapman
(74) *Attorney, Agent, or Firm*—DLA Piper US LLP

(57) ABSTRACT

Wall made of concrete or similar materials built from an unfold formwork integrated in the wall and including two formwork walls (8,8',10) placed face to face and connected by connecting elements (1) articulated to the formwork walls by stiffeners (2) attached to the formwork walls. The interval between these formwork walls after being unfolded is filled with a filler (7) such as concrete.

At least one of the formwork walls includes a casing (11,12) of concrete, mortar or similar, surcharged in relation to the stiffeners (2) and to the articulated connecting elements (1). This casing (11,12) is placed outside and/or inside the formwork wall, the stiffeners (2) and the articulated connecting elements (1) and the formwork wall 8 when it is coated forming an inner reinforcement of the wall submerged in the wall and covered by said casing.

The use of separated stiffeners, which must be inserted before pouring the concrete, is thus avoided or highly reduced.

10 Claims, 3 Drawing Sheets

U.S. PATENT DOCUMENTS

| | | | | | |
|---|---|---|---|---|---|
| 4,261,150 | A | * | 4/1981 | Sartorio | 52/405.3 |
| 4,454,702 | A | * | 6/1984 | Bonilla-Lugo et al. | 52/745.13 |
| 4,909,008 | A | * | 3/1990 | Babikian | 52/405.3 |
| 5,323,578 | A | * | 6/1994 | Chagnon et al. | 52/426 |
| 5,410,842 | A | * | 5/1995 | Watson | 49/360 |
| 5,487,248 | A | * | 1/1996 | Artzer | 52/309.12 |
| 5,687,522 | A | | 11/1997 | Durand et al. | |
| 5,794,386 | A | * | 8/1998 | Klein | 52/91.1 |
| 5,809,723 | A | * | 9/1998 | Keith et al. | 52/405.1 |
| 6,000,194 | A | * | 12/1999 | Nakamura | 52/783.17 |
| 6,070,380 | A | * | 6/2000 | Meilleur | 52/309.7 |
| 6,167,671 | B1 | * | 1/2001 | Wilson | 52/654.1 |
| 6,185,890 | B1 | * | 2/2001 | Ritter | 52/309.11 |
| 6,226,942 | B1 | * | 5/2001 | Bonin | 52/309.12 |
| 6,276,104 | B1 | * | 8/2001 | Long et al. | 52/309.4 |
| 6,282,853 | B1 | * | 9/2001 | Blaney et al. | 52/223.7 |
| 6,691,486 | B1 | * | 2/2004 | Durand | 52/645 |
| 6,701,683 | B1 | * | 3/2004 | Messenger et al. | 52/309.11 |
| 6,871,462 | B1 | * | 3/2005 | Azizinamini | 52/334 |
| 6,898,908 | B1 | * | 5/2005 | Messenger et al. | 52/268 |

FOREIGN PATENT DOCUMENTS

| | | |
|---|---|---|
| FR | 2 437 473 | 4/1980 |
| FR | 2 675 181 | 10/1992 |
| WO | WO 97 31165 | 8/1997 |

* cited by examiner

CONCRETE FORMWORK WALL SERVING ALSO AS REINFORCEMENT

TECHNICAL FIELD

The invention refers to a wall made of concrete or similar materials built from a permanent unfolded formwork integrated in the wall and including two formwork walls placed face to face and connected by articulated connecting elements to the formwork walls by means of stiffeners attached to the formwork walls, the space between these formwork walls after being unfolded being filled in with a filler such as concrete.

The invention also concerns a method for building such a wall as well as a specially adapted formwork/reinforcement for the construction of this wall.

BACKGROUND OF THE INVENTION

To raise concrete walls, formworks that define a volume in which concrete is poured are typically used. Usually, these formworks comprise: two walls placed face to face defining between them an interval where concrete is introduced, and connecting devices holding the walls with the required spacing. For example, connecting devices can be crossbars, whose ends support the formwork faces arranged one opposite the other and these crossbars being traversed by blocking pieces supported on the external faces of the formwork walls.

When the concrete is set, the formwork is recovered and the blocking pieces are withdrawn. The crossbars submerged in the concrete, which no longer have any function, can be left in place or withdrawn and do not contribute to in the strength of the wall, but on the contrary, make it more fragile.

It is essentially the quality of the concrete that confers the strength to the wall. To increase the strength of the wall with a classic formwork, horizontal and vertical reinforcements are introduced before the concrete is poured.

To increase the strength of a concrete wall, the use of permanent formworks whose water-proof or permeable walls constitute the skin of the wall is known. Mostly, these walls have waves that allow an anchorage of the skin in the concrete. This is known as collaborating formwork. The strength of the final composite structure built in this way is a superposition of the concrete strength and that of the formwork that constitutes the skin.

These walls are linked locally one to the other by crossbars traversed by recoverable blocking pieces or by fastenings whose ends anchor on said formwork walls. These fastenings extend in essentially an orthogonal direction to the formwork faces. In this case, formwork walls and the fastenings that link them help in the reinforcement of the structure of the concrete wall. According to the type of fastenings, a thermal and a mechanic decoupling for both formwork walls can be obtained.

A formwork of the type described above is discussed in the patent FR-A-2 675 181. The articulated connecting elements allow the reduction of the number of assembly operations, and facilitate the setting of the formwork while keeping its strength and its conformity to security and manufacturing standards, and have a lightweight structure.

The document WO 97/31165 describes an improvement using a slender element bent in a zigzag shape as an articulated connecting element, which distributes the forces in the concrete, parallel to the external faces of the wall, so that a skin having a hoop effect is formed. Thus, the wall is reinforced.

However, with this known device, it seems necessary or desirable to include an internal reinforcement, which is difficult to make while the formwork is being manufactured. Thus, it is necessary, on the construction site, to insert manually separated stiffeners inside the formwork. This operation is expensive and time consuming.

DESCRIPTION OF THE INVENTION

One of the objectives of the invention is to further increase the strength of concrete walls obtained with the aforementioned kind of formwork, especially by an internal reinforcement, in a simple way and eliminating or reducing the use of separated reinforcement elements to be installed on the construction site.

Another object of the invention is a wall made of concrete or similar materials built from an unfolded formwork integrated in the wall and including two formwork walls placed face to face and connected by articulated connecting elements to the formwork walls by means of stiffeners attached to the formwork walls, the interval between these unfolded formwork walls being filled by a filler such as concrete. The articulated connecting elements of this permanent formwork, after having served at first to facilitate the transport and the setting of the formwork, constitute, once the formwork is installed, an element of reinforcement that increases the strength of the wall.

According to the invention, at least one of the formwork walls includes a concrete, mortar or similar additional casing measured relative to the stiffeners and to the articulated connecting elements, this casing being arranged outside and/or inside the formwork wall. The stiffeners and the articulated connecting elements also constitute an inner reinforcement of the wall, submerged in the wall and covered by said casing. The thickness of this casing is preferably at least 2.5 cm.

Furthermore, unlike the walls according to WO 97/31165 and FR 2 675 181, the formwork walls (or at least one of them) do not constitute the skin of the wall, but are submerged within the wall by said casing, in such a way to constitute also an internal reinforcement of the wall, which considerably increases the reinforcement or "hoop" effect.

The casing of these three elements (stiffeners, articulated connections and formwork walls) reduces or eliminates the need for inserting separated stiffeners on the construction site before pouring the concrete.

The casing constitutes an integral part of the wall, solidified at the same time as the filler, thus forming a wall in which the formwork is submerged. This formwork serves therefore at the same time as reinforcement.

The steel parts of the formwork—stiffeners, articulated connecting elements and expanded metal of the walls—are thus coated with a concrete/mortar thickness preferably of at least 2.5 cm being part of the wall. This will allow then the inclusion of these elements in the calculation of the wall strength and, furthermore, the reduction, i.e. suppression, in some cases, the steel quantities to be added in the formwork. On the other hand, the casing of these parts will allow the use of a non-galvanized steel in the manufacture of the formwork, being in this way less expensive.

The invention also concerns a method for building such a wall by means of a formwork including two formwork walls placed face to face and connected by articulated connecting elements to the formwork walls by stiffeners attached to the formwork walls. These connection elements allows the walls to be kept either a spaced distance apart to define an interval intended to receive a filler such as concrete, or folded for storage and transport.

According to the inventive process, the formwork walls are unfolded and the interval between the unfolded formwork walls filled with the filling material, and:

- either, before the setting of the filler, on the external face of at least one formwork wall, a layer of mortar or similar material is applied, so as to coat the formwork wall with a surcoat preferably of at least 2.5 cm,
- or a formwork, in which at least one formwork wall is attached but spaced from the stiffeners and the articulated connecting elements, is used, and a filling material such as concrete is poured, in such a way to coat the stiffeners and the articulated connecting elements with an adjacent thickness to the formwork wall, also preferably of at least 2.5 cm.

The stiffeners, the articulated connecting elements and the formwork wall itself when it is coated, constitute therefore a reinforcement inside the built wall, submerged in the wall and covered by said casing.

The invention also concerns a folding formwork of the type described above. The formwork according to the invention is characterized in that the connecting elements of at least one formwork wall are articulatably joined to the stiffeners with a space in relation to the formwork wall, preferably of at least 2.5 cm. These stiffeners are attached to the formwork wall by spacing means so that, when the interval between the formwork walls is filled by a filler such as concrete, the wall built in this way includes an additional casing relative to the space between the stiffener and to the articulated connecting elements, as described above.

The articulated connecting elements can comprise slender elements bent generally in a zigzag pattern, as described in document WO 97/31165. Each slender bent element includes staggered opposite parts 1*a* linked by means of connecting rods 1*b* at opposing angles at both sides of each opposite part. The opposite parts alternated by the slender connecting rods are aligned in a parallel direction relative to each other and are articutalably joined to the walls, preferably by attachment means allowing only one degree of rotation freedom around the articulation axes formed by said opposite parts.

These zigzag connecting elements result in exertion on the filler of, both:

- compression forces oriented perpendicularly to the formwork faces, and
- compression forces oriented generally in a parallel direction to the external faces of said wall so as to create a skin having a hoop effect whose efficiency is increased thanks to their form and their particular arrangement assuring the distribution of the forces within the above described wall, especially in that the connection elements and the stiffeners constitute a reinforcement submerged inside the wall.

Other characteristics of the invention are shown in the dependent claims.

BRIEF DESCRIPTION OF THE DRAWINGS

The invention will be well understood with the aid of the description hereinafter, intended as a non-limiting example, with reference to the drawings that represent schematically.

PREFERRED EMBODIMENTS

Figure 1:
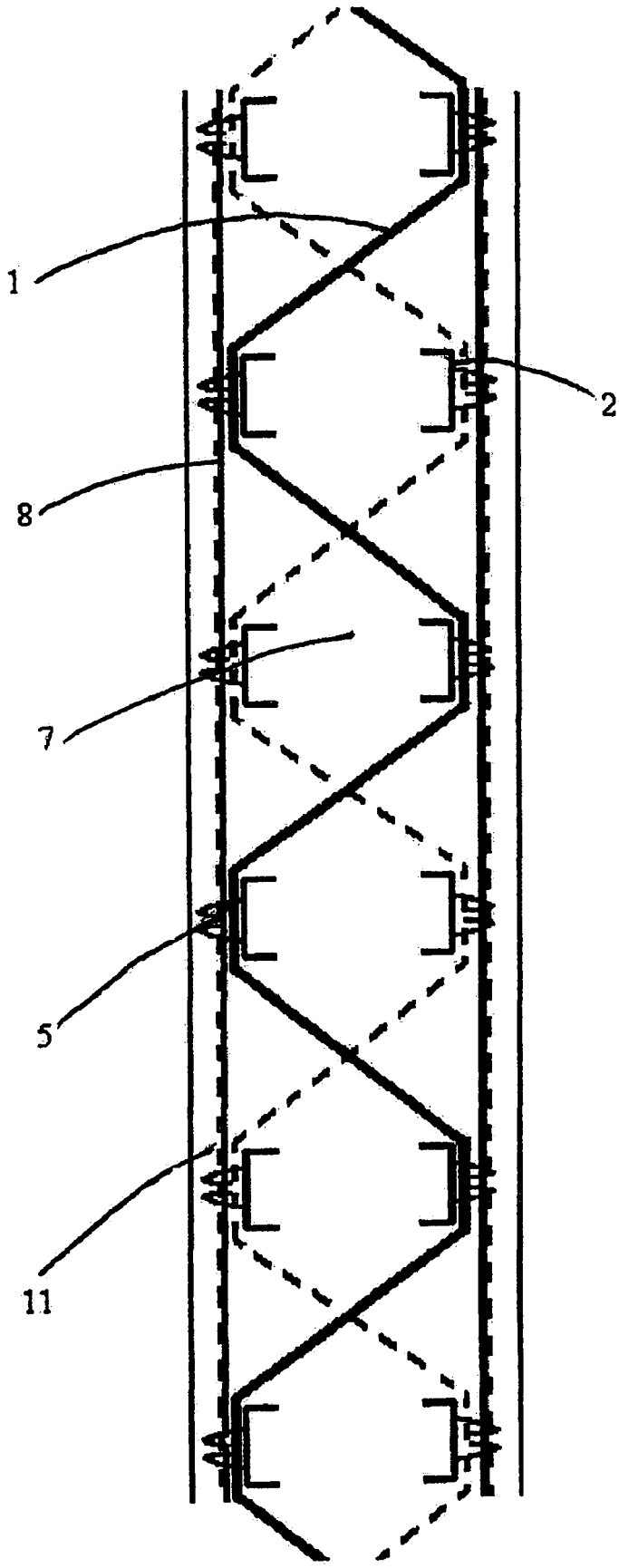
FIG. 1: a top view of a wall according to the invention including an enclosed permanent formwork.

In reference to the drawings, it can be seen that in order to build a concrete wall, a permanent collaborating formwork is used. Traditionally, this formwork includes two formwork walls 8 kept at a required spacing by means of an articulated connecting device 1 including two z-shaped connectors arranged in a zig-zag pattern, one shown with a black line, the other with a dotted line.

This connection device 1 is articulatably joined to each formwork wall 8 by means of vertical stiffeners 2 with u-shaped profiles or profiles of other shapes. This articulated joint allows the walls 8 to be kept, either with a required spacing (as shown in the Figures), or folded for the storage and transport, thus facilitating the installation of formwork.

In relation to this, connection devices 1 include straight opposite parts which extend generally in a parallel plane to the formwork faces along a predetermined length and preferably equal to the width of the stiffener 2 in order to bind in translation the connection device 1 with the stiffener 2.

The formwork walls 8 will advantageously comprise a lattice whose meshes are intended to evacuate water bleeding from the concrete. The formwork wall 8 may be iron panels or other expanded metals provided with horizontal v-shaped reinforcements, or a lattice made from non-metallic composite materials completed by horizontal v-shaped reinforcements. The stiffeners 2 are for example fixed on the walls 8 with the aid of hooking lugs 5, especially folded or bored, or by any other means (crimping, embossing, electric welding, etc.)

As discussed in document WO 97/31165, these articulated connection devices 1 result, on the filler, both in compression forces perpendicularly oriented to formwork faces 8, and in compression forces oriented in a parallel direction to external faces of the wall so as to create a skin having a hoop effect.

The connecting elements 1 thus constitute a hoop in the concrete. So, when filling the space between the walls 8 with a fluid material (concrete for example), this results in a hydrostatic pressure as high as the permeability of the walls 8 is weak. This pressure exerts traction forces on the walls 8 which exert by reaction, traction forces in the connecting pieces 1, and longitudinal compression forces in the wall 8.

These stresses are maintained until the hardening of the filler 7. It acts as a pre-stress device. After the setting, any overcharge on the wall determines a pressure in the concrete or other filler 7. This pressure exerts, in the filler 7, compression stresses in the sense where this pressure is applied, but generally traction stresses in a perpendicular sense to this direction.

Concrete being a material that does not resist traction stresses, the connecting device 1 allows this problem to be avoided. In fact, traction forces applied on the concrete 7 and in a perpendicular sense to the walls 8 lead to a stability by reaction of the traction forces in the connecting piece 1 and, by decomposition, a tangential compression force and in parallel to the walls 8.

Because of the anchorage of the walls 8 in the concrete 7 by means of stiffeners 2 and of the articulated connecting device 1, it is the assembly of the concrete 7 situated between the stiffeners 2 that is submitted to compression stresses. Thus, the device 1 allows the considerable modification of the distribution of the stresses inside the walls, when charging the latter. In fact, the higher the pressure resulting of the charge exerted along the longitudinal axis, and the higher the compression stress on the skin 8, the more the hoop effect will increase.

However, this hoop effect acting on the walls 8 as external skin can be insufficient. This is why in the practice up to now the use of reinforcements inserted in the unfolded formwork before pouring the concrete has been needed. Accordingly, in one of the embodiments of the invention, after pouring the concrete 7 but before it sets, at least one external face of the walls 8 is covered by a projection (guniting for example) of a layer of mortar 11 of a thickness of about at least 2.5 cm. These external layers 11 increase in a significant way the thickness of the wall (that is to say of the concrete) so that the stiffeners 2 (or other reinforcement elements), the connecting device 1 and the formwork wall are coated by the concrete, and can be included in the strength calculation of the wall.

The external layer 11 thus constitute an integral part of the concrete wall reinforced by the internal reinforcement. The layer 11 are therefore different from a simple finishing coat, of plasters for example, without a structural role. On the other hand, these external projected mortar layers 11 can also serve as finishing coat. Furthermore, the casing of the formwork by of the concrete/mortar allows the use of a non-galvanized steel in the manufacture of the formworks, thus decreasing costs.

Figure 2:
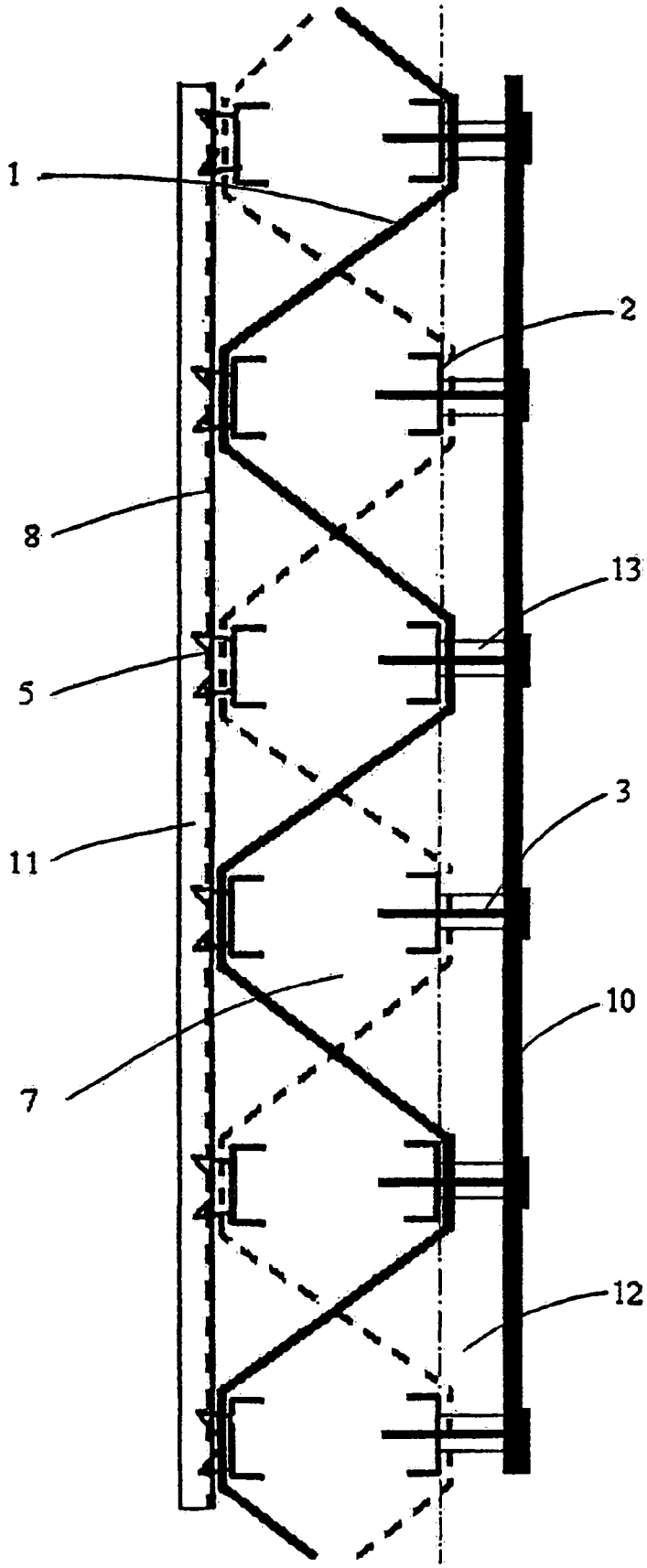
FIGS. 2 and 3: top views of two other embodiments of the wall according to the invention.

According to another embodiment of the invention disclosed in FIG. 2, the wall includes a first wall 8 in expanded metal and a second non-hemstitched wall 10 comprising a finishing panel. The connecting device 1 is articulated to the wall 8 by stiffeners 2 fixed by hooking lugs 5 or other devices, as for FIG. 1. On the side of the panel 10, the connection device 1 is articulatably joined to stiffeners 2 attached to the panel 10, but separated from this by means of holds 13 attached by screws 3. These screws 3 extend beyond the stiffeners 2 to anchor in the concrete 7. The screws 3, or other hooking pieces, especially bored metal sheets, will be coated by the concrete 7.

When the concrete, or other filler, is poured between the walls 8,10, the hemstitched wall 8 allows the evacuation of bleeding water, whenever the wall 10 is water-proof. As before, the wall 8 can be covered by a guniting projection of a mortar layer 11 of a thickness of about 2.5 cm. On the wall 10 side, the concrete, or other filler, forms a thickness 12 of at least about 2.5 cm between this wall 10 and the stiffeners 2 and the corresponding parts of the Z-shaped connectors.

Therefore, in this example, on both sides of the wall, the stiffeners 2 and the connecting device 1 form reinforcement submerged by the thicknesses 11,12, thus situated within the wall. This embodiment is particularly advantageous since it allows an internal wall ready to use to be directly obtained, and thus avoids the additional cost of a finishing coat.

Figure 3:
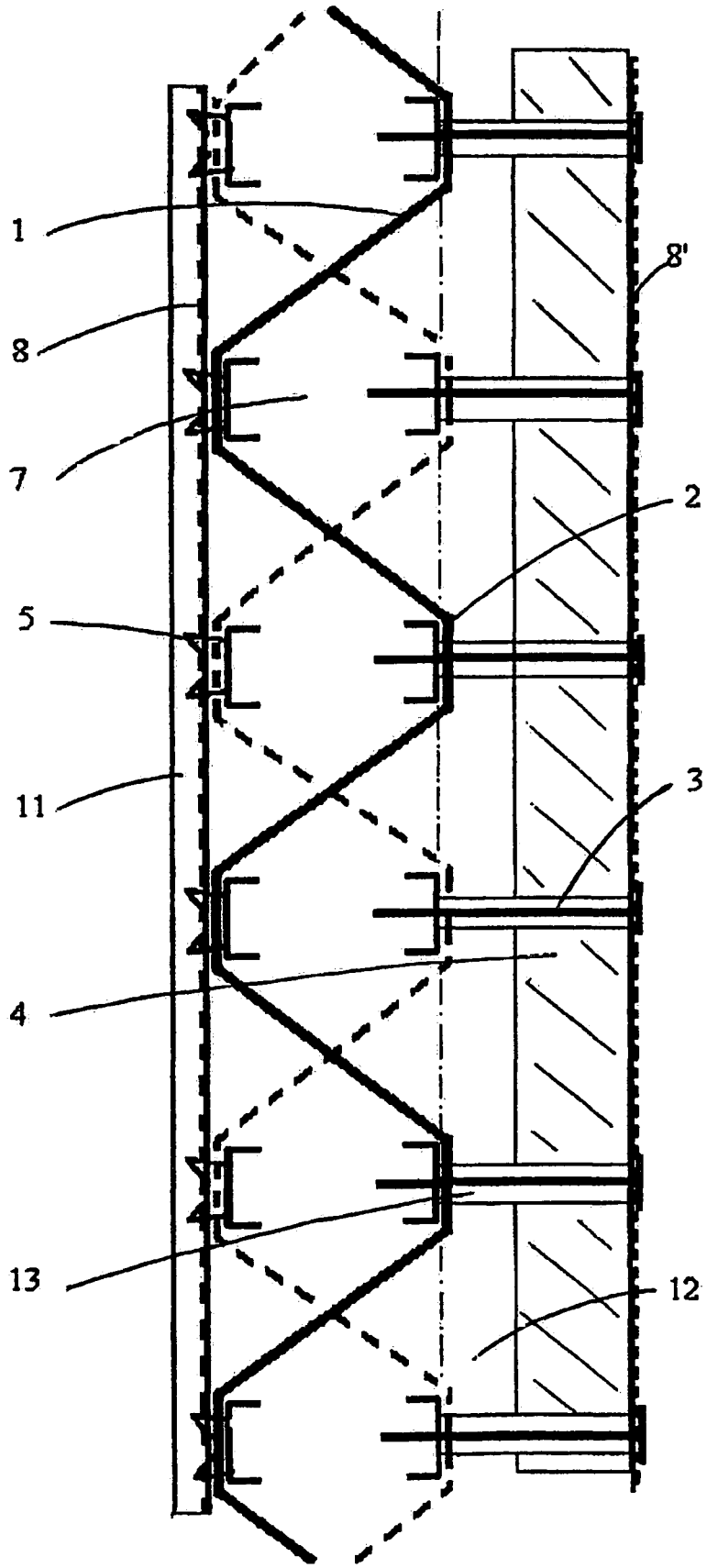

A third embodiment of the invention is disclosed in FIG. 3. The wall is similar to that of FIG. 2, but includes two perforated walls 8,8' and, furthermore, an insulating panel 4, for example of polyurethane or of rock wool or other insulating or fire-proof material, adjacent to the wall 8' which forms the external face of the wall. On this side, the connecting device 1 is articulatably joined to the stiffeners 2 attached to the panel 8' but separated from this one by means of holds 13 attached by screws 3, or other hooking means, which extend beyond the stiffeners 2.

On the wall 8' side, the concrete 7, or other filler, forms a thickness 12 between the internal face of the insulating panel 4 (which has a formwork panel effect) and the stiffeners 2 with the corresponding parts of the z-shaped connectors. According to a first embodiment, the length of the holds 3 is defined in that a space between the insulating panel 4 and the stiffeners 2 forms a thermal decoupling. According to another embodiment, the holds 3 are defined in such a way that the insulating panel 4 is held on the stiffeners 2.

This embodiment has the supplementary advantage that the insulating panel 4 is included in the folded formwork, which allows a valuable time gain during the building, because once the concrete is poured, it will no longer be necessary to come back and add the insulation. As for the previous embodiment, the stiffeners 2 and the connecting device 1 forms reinforcement submerged by a thicknesses 11, 12, thus situated within the wall.

The walls illustrated in FIGS. 1, 2 and 3 all have an increased strength comparable to that which would be obtained in a traditional wall by adding between the impervious formworks reinforcement elements such as iron bars. But their construction according to the process of the invention is simpler, faster and less expensive.

Furthermore, the use of mortar layers 11 projected by guniting allows, in the case that any less resistant filler than the concrete is used, compensation for the lack of strength of the wall.

When placing the formwork, there is a possibility to integrate the reserves (electricity and sanitary pipes).

The wall is obtained with the aid of several elementary formworks of the type described above arranged side by side. To assure continuity in the transmission of the forces and take advantage of the inertia of the totality of the wall, the length of the z-shaped connectors is longer than the length of the formwork panel along which it extends, so that the end of an exceeding panel can hook onto a contiguous panel.

At least certain z-shaped connectors will be provided with heating elements (not shown) such as thermistors to form a radiant wall in some embodiments. The use of the thermistors allows the emission of heat by creating a potential difference between the formwork walls.

Usually, the part of the z-shaped connectors is fixed on the formwork wall 8,10 by attachment means in rotation with only a degree of freedom around a parallel axis at the plane of the formwork faces, perpendicularly to the vertical axis of the stiffeners 2 and excluding any other degree of freedom.

As a variant, instead of having straight parts, the articulated parts of the connecting elements 1 may be angled, and articulated in the middle of a vertical stiffener 2 of the type disclosed herein, or of a reduced size, or articulated behind the vertical stiffeners in a wedge shape.

Instead of u-shaped stiffeners 2, this reinforcement could advantageously be constituted by simple iron bars as those used for concrete reinforcement. These bars would be attached to formwork walls by spacing pieces for example.

To assure an acoustic and mechanic decoupling, attachment of the connection devices 1 on the formwork walls 8,10 can be done with elastic materials such as rubber.

To improve the transmission of forces, the highest point of the waves of the slender element 1 bent in zigzag are attached to a slender piece which reinforces the inertia of the formwork (see FIGS. 5 and 6 of WO 97/31165). To help this slender piece, it can be easily conferred to the z-shaped connecting element 1 and to the formwork walls 8 a curved form that can be memorized by attaching on the opposed side of the element 1 another longitudinal piece. Thus, the pitch determination, different on both sides of elements 1, imposes non-identical developed lengths that so develop the curved surface of the panels of the formwork.

The connecting elements 1 of a formwork panel are for example arranged in a staggered pattern (FIGS. 1 to 3). Therefore a three-dimensional connection is constituted. It is also possible to use just a connection in Z 1 so that the highest points of the waves are staggered.

The invention claimed is:

1. A method for building a wall using a formwork including two formwork walls placed face to face and connected by connecting elements articulatably joined to the formwork walls by stiffeners attached to the formwork walls, the connecting elements allowing the walls to be kept either spaced apart to define an interval intended to receive a filler such as concrete or folded for storage and transport, comprising the steps of:

unfolding the formwork walls; and filling the interval between the unfold formwork walls with a filler;

wherein either, before the setting of the filler, a casing is applied on the external face of at least one formwork wall in such a way to coat the formwork wall, or at least one formwork wall is attached to but spaced from the stiffeners and the connecting elements, and a filler material, such as concrete, is poured so as to coat the stiffeners and the connecting elements with a casing adjacent to the formwork wall, the stiffeners and the connecting elements forming thus a reinforcement inside the wall, the stiffeners and the connecting elements being submerged in the wall and covered by said casing.

2. The method according to claim 1, wherein at least one formwork wall is a lattice.

3. The method according to claim 1, wherein the stiffeners have a U-shaped cross-section.

4. The method according to claim 1, wherein the connecting elements are articulatably joined to the stiffeners of at least one form work wall with a spacing relative to the formwork wall, the stiffeners being attached to the formwork wall by means of the spacing elements such that the filler includes an additional casing relative to the space between the stiffeners and the connecting elements.

5. The method according to claim 1, further comprising the step of placing an insulating panel inside the formwork.

6. The method according to claim 1, wherein the connecting elements comprise slender elements bent in a zigzag pattern forming a hoop within the wall.

7. The method according to claim 6, wherein the wall includes two slender elements staggered relative to each other so that their staggered opposite parts are arranged facing each other.

8. A method according to claim 1, wherein a casing is applied on at least one wall by projection.

9. A method according to claim 1, wherein the casing has a thickness of at least about 2.5 cm.

10. The method of claim 2, wherein the lattice is selected from the group consisting of a panel made of expanded metal and a lattice made of composite materials including horizontal V-shaped reinforcements.

* * * * *